US010113138B2

(12) United States Patent
Shen et al.

(10) Patent No.: US 10,113,138 B2
(45) Date of Patent: Oct. 30, 2018

(54) APE-FREE SURFACTANT COMPOSITIONS AND USE THEREOF IN TEXTILE APPLICATIONS

(71) Applicant: Dow Global Technologies LLC, Midland, MI (US)

(72) Inventors: Cheng Shen, Shanghai (CN); Jing Ji, Shanghai (CN); Jianhai Mu, Shanghai (CN); Xiaohua Wang, Shanghai (CN)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 15/102,551

(22) PCT Filed: Dec. 11, 2013

(86) PCT No.: PCT/CN2013/089063

§ 371 (c)(1),
(2) Date: Jun. 8, 2016

(87) PCT Pub. No.: WO2015/085509

PCT Pub. Date: Jun. 18, 2015

(65) Prior Publication Data

US 2017/0002296 A1 Jan. 5, 2017

(51) Int. Cl.

| | |
|---|---|
| ***C11D 1/83*** | (2006.01) |
| ***C11D 1/722*** | (2006.01) |
| ***C11D 1/29*** | (2006.01) |
| ***C11D 3/04*** | (2006.01) |
| ***C11D 3/39*** | (2006.01) |
| ***C11D 11/00*** | (2006.01) |
| *B01F 17/00* | (2006.01) |

(52) U.S. Cl.

CPC ..... *C11D 1/83* (2013.01); *C11D 1/29* (2013.01); *C11D 1/722* (2013.01); *C11D 3/044* (2013.01); *C11D 3/3942* (2013.01); *C11D 11/0017* (2013.01)

(58) Field of Classification Search

CPC ..... C11D 1/83; C11D 11/0017; C11D 3/3942; C11D 3/044; C11D 1/29; C11D 1/722; B01F 17/0092; B01F 17/0057; C08G 65/326; C08G 65/3344; C07C 309/68; C08F 2/26; C08F 2/30; C08L 71/02; C08L 2205/02

USPC .... 516/30, 58, 200; 510/128, 351, 535, 536, 510/537

See application file for complete search history.

(56) References Cited

U.S. PATENT DOCUMENTS

| | | | | |
|---|---|---|---|---|
| 3,931,271 | A * | 1/1976 | Baumann | C07C 29/52 510/357 |
| 4,259,215 | A * | 3/1981 | Murata | C11D 1/29 510/329 |
| 4,395,364 | A * | 7/1983 | Murata | C11D 1/37 510/324 |
| 4,608,197 | A * | 8/1986 | Kesling, Jr. | C07C 305/00 510/537 |
| 7,713,921 | B2 * | 5/2010 | Boutique | C11D 1/83 510/343 |
| 8,338,356 | B2 | 12/2012 | Mu et al. | |
| 8,580,727 | B2 * | 11/2013 | Man et al. | B08B 3/04 510/340 |
| 9,555,385 | B2 * | 1/2017 | Shen | C07C 305/10 |
| 2008/0207939 | A1 * | 8/2008 | Tropsch | A61K 8/463 558/34 |
| 2010/0305254 | A1 * | 12/2010 | Ikenaga | C08F 2/26 524/156 |
| 2011/0245131 | A1 * | 10/2011 | Mu | C11D 1/722 510/351 |
| 2012/0066840 | A1 | 3/2012 | Man et al. | |
| 2012/0115769 | A1 * | 5/2012 | Nomura | C11D 1/8305 510/351 |
| 2015/0224462 | A1 * | 8/2015 | Shen | C08F 2/26 516/20 |
| 2015/0367307 | A1 * | 12/2015 | Shen | C07C 305/10 524/831 |

FOREIGN PATENT DOCUMENTS

| | | |
|---|---|---|
| CN | 101775339 | 7/2010 |

OTHER PUBLICATIONS

International Search Report and Written Opinion for related PCT Application PCT/CN2013/089063, dated Sep. 19, 2014 (12 pgs).

* cited by examiner

*Primary Examiner* — Daniel S Metzmaier
(74) *Attorney, Agent, or Firm* — Brooks, Cameron & Huebsch, PLLC

(57) ABSTRACT

A process for scouring textile materials is provided. The process comprising contacting the textile material with scouring textile materials, comprising contacting the textile materials with a composition comprising an alkyl alkoxylate sulfate of formula I, a nonionic alkyl alkoxylate of formula II, and water.

11 Claims, No Drawings

APE-FREE SURFACTANT COMPOSITIONS AND USE THEREOF IN TEXTILE APPLICATIONS

This application is a National Stage Application under 35 U.S.C. § 371 of International Application Number PCT/CN2013/089063, filed Dec. 11, 2013 and published as WO 2015/085509 on Jun. 18, 2015, the entire contents of which are incorporated herein by reference in its entirety.

FIELD

This invention relates to a process of scouring textile materials using an alkylphenol ethoxylate (APE)-free surfactant composition. The surfactant composition includes an alkyl alkoxylate sulfate of the chemical structure described below.

BACKGROUND

With increasing awareness on environmental impact, eco-friendly surfactants or surfactant compositions are becoming widely used in different applications, for example, scouring. Scouring is used to remove waxes and oils, such as pectin, mineral oil, animal oil, and vegetable oil, from textiles materials such as fabric, yarn, or any other woven material comprising a network of natural or artificial fibers. Scouring is usually performed on raw materials, such as sheep's wool or artificial fibers from a manufacturing plant. For example, certain textile materials, such cotton fabrics, need to be thoroughly cleaned before they can be dyed. Other commercial surfactant compositions may be used for scouring textile materials, such as $C_{12}$ alcohol ethoxysulfate and secondary alkane sulphonates. However, $C_{12}$ alcohol ethoxysulfate exhibits poor wetting and high foam and certain aqueous solutions of secondary alkane sulphonates are hazy at a high pH, indicating low solubility. Thus, there is still a need for environmentally friendly surfactant compositions that exhibit better foaming and wetting properties in alkaline water solution (scouring is usually performed under alkaline conditions) and thus better scouring performance than the present compositions.

BRIEF SUMMARY

In one aspect, a process of removing wax or oil from a textile material is provided. The process comprises contacting the textile material with a composition comprising:

an alkyl alkoxylate sulfate of formula I:

$$R^1O—(CH_2CH(R^2)—O)_x—(CH_2CH_2O)_y—SO_3M \quad (I);$$

a nonionic alkyl alkoxylate of formula II:

$$R^1O—(CH_2CH(R^2)—O)_x—(CH_2CH_2O)_y—H \quad (II); \text{ and}$$

water wherein $R^1$ is linear or branched $C_4$-$C_{10}$ alkyl;

$R^2$ is $CH_3$ or $CH_3CH_2$;

x is a real number from 1 to 11;

y is a real number from 1 to 20; and

M is an alkali metal or $NH_4$, and wherein $R^1$, $R^2$, x, and y in formula I and formula II may be the same or different.

The composition may also comprise sodium hydroxide and/or hydrogen peroxide. The amount of the alkyl alkoxylate sulfate of formula I may be from 20 to 70% by weight, the amount of the nonionic alkyl alkoxylate of formula II may be from 0.1 to 30% by weight, the amount of water is from 25 to 75% by weight, the amount of the sodium hydroxide may be from 0 to 5% by weight, and the amount of the hydrogen peroxide may be 0 to 5% by weight, based on the total weight of the anionic alkyl alkoxylate sulfate of formula I, the nonionic alkyl alkoxylate of formula II, the water, the sodium hydroxide, and the hydrogen peroxide.

DETAILED DESCRIPTION

As discussed above, scouring is used to remove waxes and oils, such as pectin, mineral oil, animal oil, and vegetable oil, from textiles materials such as fabric, yarn, or any other woven material comprising a network of natural or artificial fibers. Scouring is used for the pre-treatment of fabric in textile processing. Surfactants are used as scouring agents in order to remove waxes and oils from the textile materials. In order to obtain good scouring performance (i.e., effective removal of waxes and oils), the surfactant composition should have comparable or better wetting/emulsification/dispersion performance, surface tension, foaming properties (foam height and foam collapse), and stability in alkaline solution to commercial surfactants such as secondary alkane sulphonates. These properties allow the surfactant to penetrate the textile material, surround the wax or oil and remove them.

The surfactant composition of the present invention has such properties, which makes it a good wetting/emulsifying agent, and thus a good scouring agent. During scouring by wetting/emulsification, the wax or oil may be suspended in water, allowing it to be removed. The surfactant composition of the present invention is also environmentally friendly.

The present disclosure provides a process for scouring such textile materials by contacting the textile with a surfactant composition. The composition may comprise an alkyl alkoxylate sulfate, a nonionic alkyl alkoxylate, and water. The composition may further comprise sodium hydroxide and hydrogen peroxide. Hydrogen peroxide may be used for additional whitening.

Unless otherwise indicated, numeric ranges, for instance as in "from 2 to 10," are inclusive of the numbers defining the range (e.g., 2 and 10).

Unless otherwise indicated, ratios, percentages, parts, and the like are by weight.

As noted above, the invention provides a process for scouring textile materials using a surfactant composition comprising an alkyl alkoxylate sulfate of formula I. The surfactant composition exhibits several useful properties, including one or more of good surface tension reduction, low foam and quick foam collapse, rapid wetting, and calcium ion stability. The advantageous properties render the surfactant composition suitable as a scouring agent for textile materials.

The inventors have found that the alkyl alkoxylate sulfate surfactant exhibits a synergistic effect during scouring when combined with a nonionic alkyl alkoxylate surfactant. Thus, the alkyl alkoxylate sulfate surfactant combined with a nonionic alkyl alkoxylate surfactant exhibits better scouring performance than the alkyl alkoxylate sulfate surfactant alone.

The alkyl alkoxylate sulfate is of the following formula I:

$$R^1O—(CH_2CH(R^2)—O)_x—(CH_2CH_2O)_y—SO_3M \quad (I)$$

wherein $R^1$ is linear or branched $C_4$-$C_{10}$ alkyl; $R^2$ is $CH_3$ or $CH_3CH_2$; x is a real number from 1 to 11; y is a real number from 1 to 20; and M is an alkali metal or $NH_4$.

$R^1$ in formula I can be a linear or branched $C_6$-$C_{10}$ alkyl, alternatively linear or branched $C_8$-$C_{10}$ alkyl, preferably a linear or branched $C_8$ alkyl. $R^1$ is 2-ethylhexyl ($CH_3CH_2CH_2CH_2CH(CH_2CH_3)CH_2$—). $R^1$ can be 2-propylheptyl ($CH_3CH_2CH_2CH_2CH_2CH(CH_2CH_2CH_3)CH_2$—).

$R^2$ in formula I is desirably selected from $CH_3$ and $CH_3CH_2$.

x in formula I is from 4 to 6, preferably 5.

y in formula I is from 1 to 11, alternatively from 3 to 11, preferably 3.

M in formula I is sodium, potassium, or ammonium. M is preferably sodium or ammonium.

It is preferred that, in addition to the alkyl alkoxylate sulfate of formula I, the surfactant composition also comprises a nonionic alkyl alkoxylate of formula II:

$$R^1O—(CH_2CH(R^2)—O)_x—(CH_2CH_2O)_y—H \quad (II)$$

wherein $R^1$ is linear or branched $C_4$-$C_{10}$ alkyl; $R^2$ is $CH_3$ or $CH_3CH_2$; x is a real number from 1 to 11; and y is a real number from 1 to 20.

$R^1$ in formula II is linear or branched $C_6$-$C_{10}$ alkyl, alternatively linear or branched $C_8$-$C_{10}$ alkyl. $R^1$ is desirably selected from 2-ethylhexyl ($CH_3CH_2CH_2CH_2CH(CH_2CH_3)CH_2$—) or 2-propylheptyl ($CH_3CH_2CH_2CH_2CH_2CH(CH_2CH_2CH_3)CH_2$—).

$R^2$ in formula II is desirably selected from $CH_3$ and $CH_3CH_2$.

x in formula II is from 4 to 6.

y in formula II is from 1 to 11, alternatively from 3 to 11.

When the nonionic alkyl alkoxylate of formula II is present in the surfactant composition, the groups $R^1$, $R^2$, x, and y in formula I and formula II may be the same or different. The groups $R^1$, $R^2$, x, and y in formula I and formula II can be the same.

The surfactant composition of the invention may comprise an alkyl alkoxylate sulfate of formula I and a nonionic alkyl alkoxylate of formula II, wherein the weight ratio of the alkyl alkoxylate sulfate of formula I to the nonionic alkyl alkoxylate of formula II is from 99:1 to 10:90, from 95:5 to 50:50, or from 90:10 to 70:30.

The surfactant composition of the invention may further comprise water.

The surfactant composition of the invention may comprise an alkyl alkoxylate sulfate of formula I, a nonionic alkyl alkoxylate of formula II, and water. The amount of the alkyl alkoxylate sulfate of formula I may be from 20 to 70% by weight, preferably from 30 to 60% by weight; the amount of the alkoxylate of formula II may be from 0.1 to 30% by weight, preferably from 0.1 to 10% by weight; and the amount of water may be from 25 to 75% by weight, preferably from 40 to 70% by weight, based on the total weight of the alkyl alkoxylate sulfate of formula I, the nonionic alkyl alkoxylate of formula II, and the water.

The surfactant composition of the invention may comprise additional additives, such as other surfactants/emulsifiers. The surfactant composition of the invention further may comprise a nonionic surfactant of the formula III: $R^3O$-$(AO)_z$—H (III), wherein $R^3$ is linear or branched $C_6$-$C_{24}$alkyl, AO at each occurrence is ethyleneoxy, propyleneoxy, butyleneoxy, or random or block mixtures thereof, and z is from 1 to 50. Preferably, the surfactant composition does not include a cationic surfactant.

The surfactant compositions of the invention exhibit properties that are similar or better than commercial surfactants, such as good surface tension reduction, low foam and quick foam collapse, and rapid wetting, and they provide formulation stability properties, including good $Ca^{2+}$ stability. $Ca^{2+}$ stability may be understood as the tolerance of divalent electrolytes present in hard water.

Nonionic alkyl alkoxylates of formula II as described above may be purchased from commercial vendors or they may be prepared by those skilled in the art using literature techniques (see for instance United States Patent publication number 2011/0098492, which is incorporated herein by reference). In a typical procedure, a suitable alcohol or fatty acid is alkoxylated with alkylene oxide compounds. Alkoxylation processes may, for instance, be carried out in the presence of acidic or alkaline catalysts, or by using metal cyanide catalysts. Alkaline catalysts may include, for instance, hydroxides or alcoholates of sodium or potassium, including NaOH, KOH, sodium methoxide, potassium methoxide, sodium ethoxide and potassium ethoxide. Base catalysts are normally used in a concentration of from 0.05 percent to about 5 percent by weight, preferably about 0.1 percent to about 1 percent by weight based on starting material.

The addition of alkylene oxides may, for instance, be carried out in an autoclave under pressures from about 10 psig ($6.9\times10^4$ Pascal) to about 200 psig ($1.4\times10^6$ Pascal), preferably from about 60 psig ($4.1\times10^5$ Pascal) to about 100 psig ($6.9\times10^5$ Pascal). The temperature of alkoxylation may range from about 30° C. to about 200° C., preferably from about 100° C. to about 160° C. After completion of oxide feeds, the product is typically allowed to react until the residual oxide is less than about 10 parts per million (ppm) relative to the final product. After cooling the reactor to an appropriate temperature ranging from about 20° C. to 130° C., the residual catalyst may be left unneutralized, or neutralized with organic acids, such as acetic, propionic, or citric acid. Alternatively, the product may be neutralized with inorganic acids, such as phosphoric acid or carbon dioxide. Residual catalyst may also be removed using ion exchange or an adsorption media, such as diatomaceous earth.

Alkyl alkoxylates sulfate of formula I may be prepared by the sulfation of nonionic alkyl alkoxylates of formula II. For instance, the Chemithon® sulfation process via sulfur trioxide is a sulfation process well known to those skilled in the art. Typically, pre-heated nonionic alkyl alkoxylate (40° C.) may be firstly contacted with an air-diluted sulfur trioxide in a continuous thin-film reactor, resulting is a quick and exothermic reaction. The crude sulfuric ester acid may be collected at about 55° C. A prompt neutralization by NaOH or $NH_4OH$ to transform sulfuric ester acid to sulfate salt is advantageous to avoid dark color formation and to reduce formation of impurities. Precise control of the molar ratio of $SO_3$ to nonionic alkyl alkoxylate is preferred in order to produce high quality alkyl alkoxylate sulfate.

EXAMPLES

Materials used in the examples include the following:

"Alkyl alkoxylate sulfate" means 2-ethylhexyl-O—$(CH_2CH(CH_3)—O)_{5.5}—(CH_2CH_2O)_3—SO_3Na$.

"Nonionic alkyl alkoxylate" means 2-ethylhexyl-O—$(CH_2CH(CH_3)—O)_{5.5}—(CH_2CH_2O)_3—H$.

1. Comparison of Surfactant Properties

To evaluate the scouring performance of the composition used in the present invention, comparative studies are carried out with commercially available surfactants, $C_{12}$ alcohol ethoxysulfate and the $C_{10-14}$ secondary alkane sulphonate.

TABLE 1

Surfactant Properties of alkyl alkoxylate sulfate, $C_{12}$ alcohol ethoxysulfate and the $C_{10-14}$ secondary alkane sulphonate

| Properties | Alkyl Alkoxylate Sulfate | $C_{12}$ alcohol ethoxy-sulfate | $C_{10-14}$ Secondary Alkane Sulphonate |
|---|---|---|---|
| Active content (%) | 30 | 30-32 | 60 |
| Appearance (20° C.) | clear, pale yellow liquid | clear, pale yellow | Yellow soft paste |
| Surface Tension at CMC (mN/m, 20° C.) | 35 | 42 | 33 |
| CMC (ppm) | 3000 | 125 | 1800 |
| Foam Height (mm, Ross Miles, 0/5 min at 0.2%) | 108/24 | 113/112 | 83/73 |
| $Ca^{2+}$ stability ($CaCl_2$, 1% Surfactant) | 10-15% wt | ≈15% wt. | <0.5% wt. |

TABLE 1-continued

Surfactant Properties of alkyl alkoxylate sulfate, $C_{12}$ alcohol ethoxysulfate and the $C_{10-14}$ secondary alkane sulphonate

| Properties | Alkyl Alkoxylate Sulfate | $C_{12}$ alcohol ethoxy-sulfate | $C_{10-14}$ Secondary Alkane Sulphonate |
|---|---|---|---|
| Anti-alkaline (NaOH, 1% surfactant) | 5-10% wt | 10-15% wt. | <2% wt. |

As shown in Table 1, the alkyl alkoxylate sulfate has better surfactant properties than the $C_{12}$ alcohol ethoxysulfate and the $C_{10-14}$ secondary alkane sulphonate. For example, it has lower surface tension than the $C_{12}$ alcohol ethoxysulfate and better resistance to $Ca^{2+}$ than the $C_{10-14}$ secondary alkane sulphonate. In addition, the solution remains clear (i.e., soluble) in a higher alkaline concentration than the $C_{10-14}$ secondary alkane sulphonate. It also has low foaming and quick collapse foam property, while the comparative surfactants have almost no foam collapse property.

2. Evaluation of Wetting Performance in Alkaline Solution

Comparative evaluation of the wetting performance of alkyl alkoxylate sulfate, the $C_{12}$ alcohol ethoxysulfate, the $C_{10-14}$ secondary alkane sulphonate (all blended with the nonionic alkyl alkoxylate) is carried out according to the Draves wetting test in an alkaline aqueous solution.

Draves Wetting Test in Alkaline Solution 1. 1 liter of NaOH aqueous solutions are prepared at concentration of 2%, 5%, and 8% wt., then, surfactant is added into the NaOH aqueous soluiton at 0.1% wt. of active content.
2. A commercially available canvas (textile material) with homogeneous round size (diameter 25 mm) is put in the surfactant aqueous solution.
3. The wetting time and penetration time are recorded.

The test is repeated twelve times (in order to delete the maximum and minimum data), and the average wetting time is calculated. Comparative results of the wetting performance are shown in Table 2.

TABLE 2

Comparative wetting performance of alkyl alkoxylate sulfate, $C_{12}$ alcohol ethoxysulfate and $C_{10-14}$ secondary alkane sulphonate blended with nonionic alkyl alkoxylate

| | Nonionic | Inventive example 1 alkyl alkoxylate sulfate* | | Comparative example 2 $C_{12}$ alcohol ethoxysulfate | | Comparative example 3 $C_{10-14}$ secondary alkane sulphonate | |
|---|---|---|---|---|---|---|---|
| NaOH [C], % | alkyl alkoxylate, % in blend | Wetting (s) | Penetrating (s) | Wetting (s) | Penetrating (s) | Wetting (s) | Penetrating (s) |
| 2% | 10% | 124.2 +/− 9.92 | Same (as penetrating) | >300 | >300 | 11.6 +/− 0.79 | 13.5 +/− 1.40 |
| | 20% | 62.0 +/− 3.07 | Same | >300 | >300 | 8.8 +/− 0.30 | 10.7 +/− 0.77 |
| 5% | 10% | 115.9 +/− 4.76 | Same | >300 | >300 | 60.6 +/− 11.84 | 287.5 +/− 51.35 |
| | 20% | 47.0 +/− 2.04 | Same | 163.5 +/− 6.75 | Same | 17.1 +/− 0.57 | 20.2 +/− 1.73 |
| 8% | 10% | 83.4 +/− 5.68 | Same | 141.1 +/− 31.65 | Same | 76.4 +/− 7.05 | >300 |
| | 20% | 85.2 +/− 3.81 | Same | >300 | >300 | 31.6 +/− 5.79 | 135.2 +/− 18.89 |

*Surfactant aqueous solution with active [C] = 0.1% wt.

As shown in Table 2, once the concentration of NaOH increases to 8% wt., the alkyl alkoxylate sulfate shows similar wetting performance as the $C_{10-14}$ secondary alkane sulphonate when blended with 10% nonionic alkyl alkoxylate.

3. Evaluation of Scouring Performance

The scouring performance of the formulations in Table 3 are evaluated.

Scouring Test Method

1. Formulation in scouring: $H_2O_2$, NaOH, surfactant.
2. Scouring condition: 98-100° C. for 40 minutes.
3. Post-scouring rinsing with water (90° C./60° C./40° C./R.T.).
4. Drying: 120° C. for 2 min, then, with setting machine.
5. Whiteness test is needed for the cloth before and after scouring.
6. Cloth: knitted fabric.
7. Cloth size: length (20-30 cm); width (~5 cm).

Capillary Effect Measurement

A cleaned cloth is sized to 3 pieces for length in the range of 20-30 cm and width about 5 cm; the piece of cloth is hung with about 1 cm of depth immersed in DI water. After 5 minutes, the wetting height is recorded. Scouring formulations (in grams) are shown in Table 3 and scouring results are shown in Table 4.

TABLE 3

Scouring formulations

| Scouring formulation (unit: grams) | Inventive example 4 alkyl alkoxylate sulfate | | | Comparative example 5 $C_{12}$ alcohol ethoxysulfate | | | Comparative example 6 $C_{10-14}$ secondary alkane sulphonate | | | Blank (no surfactant) |
|---|---|---|---|---|---|---|---|---|---|---|
| NaOH | | 0.2 | | | 0.2 | | | 0.2 | | 0.2 |
| $H_2O_2$ (35%)* | | 0.5 | | | 0.5 | | | 0.5 | | 0.5 |
| alkyl alkoxylate sulfate (30.4% active)* | 0.99 | 0.89 | 0.79 | — | — | — | — | — | — | — |
| $C_{12}$ alcohol ethoxysulfate (30% active)* | — | — | — | 1.00 | 0.90 | 0.80 | — | — | — | — |
| $C_{10-14}$ secondary alkane sulphonate (60% active)* | — | — | — | — | — | — | 0.5 | 0.45 | 0.4 | — |
| Nonionic alkyl alkoxylate | 0 | 0.03 | 0.06 | 0 | 0.03 | 0.06 | 0 | 0.03 | 0.06 | — |
| Water | 198.3 | 198.4 | 198.4 | 198.3 | 198.4 | 198.4 | 198.8 | 198.8 | 198.8 | 199.3 |

*The non-active portion is water.

TABLE 4

Performance results before and after scouring

| Performance Evaluation | | Inventive example 4 alkyl alkoxylate sulfate | | | Comparative example 5 $C_{12}$ alcohol ethoxysulfate | | | Comparative example 6 $C_{10-14}$ secondary alkane sulphonate | | | Blank (no surfactant) |
|---|---|---|---|---|---|---|---|---|---|---|---|
| +% wt. of Nonionic alkyl alkoxylate | | 0% | 10% | 20% | 0% | 10% | 20% | 0% | 10% | 20% | — |
| Whiteness before | | 50.4 | 50.7 | 50.4 | 50.8 | 50.6 | 50.7 | 50.4 | 50.5 | 50.9 | 50.6 |
| | | 50.7 | 50.4 | 50.5 | 50.9 | 50.7 | 50.7 | 50.6 | 50.6 | 50.6 | 50.5 |
| | | 50.7 | 50.6 | 50.7 | 50.7 | 50.8 | 50.6 | 50.8 | 50.6 | 50.6 | 50.7 |
| | | 50.9 | 50.6 | 50.7 | 50.6 | 50.8 | 50.6 | 50.8 | 50.6 | 50.7 | 50.7 |
| | Av. | 50.7 | 50.6 | 50.6 | 50.8 | 50.7 | 50.7 | 50.7 | 50.6 | 50.7 | 50.6 |
| | Std. | 0.21 | 0.13 | 0.15 | 0.13 | 0.08 | 0.14 | 0.19 | 0.05 | 0.14 | 0.10 |
| after | | 75.7 | 76.4 | 76.2 | 76.1 | 75.9 | 75.9 | 76.2 | 76.5 | 76.2 | 68.7 |
| | | 75.8 | 76.1 | 76.3 | 76.1 | 76.0 | 76.0 | 76.4 | 76.4 | 76.3 | 68.9 |
| | | 75.9 | 76.1 | 76.2 | 75.9 | 75.9 | 75.8 | 76.4 | 76.7 | 76.4 | 69.0 |
| | | 75.8 | 76.4 | 76.3 | 75.7 | 75.9 | 75.9 | 76.5 | 76.5 | 76.4 | 69.3 |
| | Av. | 75.8 | 76.3 | 76.3 | 76.0 | 75.9 | 75.9 | 76.4 | 76.5 | 76.3 | 69.0 |
| | Std. | 0.08 | 0.17 | 0.06 | 0.19 | 0.05 | 0.08 | 0.13 | 0.13 | 0.10 | 0.25 |
| Improve rate % | | 49.6 | 50.8 | 50.8 | 49.7 | 49.8 | 49.9 | 50.8 | 51.3 | 50.5 | 36.3 |

TABLE 5

Wetting performance

| Wetting Evaluation | Inventive example 4 alkyl alkoxylate sulfate | | | Comparative example 5 $C_{12}$ alcohol ethoxysulfate | | | Comparative example 6 $C_{10-14}$ secondary alkane sulphonate | | | Blank (no surfactant) |
|---|---|---|---|---|---|---|---|---|---|---|
| +% wt. of Nonionic alkyl alkoxylate | 0% | 10% | 20% | 0% | 10% | 20% | 0% | 10% | 20% | — |

TABLE 5-continued

| Wetting performance | | | | | | | | | | | |
|---|---|---|---|---|---|---|---|---|---|---|---|
| Wetting Evaluation | | Inventive example 4 alkyl alkoxylate sulfate | | | Comparative example 5 $C_{12}$ alcohol ethoxysulfate | | | Comparative example 6 $C_{10-14}$ secondary alkane sulphonate | | | Blank (no surfactant) |
| Capillary | | 8.5 | 9.5 | 9.9 | 8.0 | 8.3 | 9.7 | 11.3 | 11.3 | 11.0 | 0 |
| effect | | 8.7 | 9.4 | 9.9 | 8.1 | 8.2 | 9.7 | 11.5 | 11.3 | 11.2 | 0 |
| (cm/5 min) | | 8.8 | 9.3 | 9.8 | 8.1 | 8.3 | 9.8 | 11.3 | 11.2 | 11.0 | 0 |
| | Av. | 8.7 | 9.4 | 9.9 | 8.1 | 8.3 | 9.7 | 11.4 | 11.3 | 11.1 | 0 |
| | Std. | 0.15 | 0.10 | 0.06 | 0.06 | 0.06 | 0.06 | 0.12 | 0.06 | 0.12 | — |

As shown in Table 4, the whiteness of alkyl alkoxylate sulfate improves in the presence of the nonionic alkyl alkoxylate. The whiteness values of the two comparative surfactants remain the same after the addition of the nonionic alkyl alkoxylate.

As for the capillary effect shown in Table 5, both the alkyl alkoxylate sulfate and the $C_{12}$ alcohol ethoxysulfate show improvement on capillary effect performance after the addition of 10-20% wt. of the nonionic alkyl alkoxylate. There is no increased capillary effect for $C_{10-14}$ secondary alkane sulphonate in the presence of the nonionic alkyl alkoxylate. Thus, the wetting performance of the alkyl alkoxylate sulfate improves in the presence of the nonionic alkyl alkoxylate and with increase of the alkaline concentration (NaOH).

In the scouring performance evaluation, the blend with nonionic alkyl alkoxylate helps the alkyl alkoxylate sulfate achieve similar performance as the $C_{10-14}$ secondary alkane sulphonate and better performance than the $C_{12}$ alcohol ethoxysulfate on whiteness improvement; while, no synergic effect is observed when the nonionic alkyl alkoxylate is added to the $C_{10-14}$ secondary alkane sulphonate.

The description of the invention above can be modified within the spirit and scope of this disclosure. This application is therefore intended to cover any variations, uses, or adaptations of the invention using the general principles disclosed herein. Further, the application is intended to cover such departures from the present disclosure as come within the known or customary practice in the art to which this invention pertains and which fall within the limits of the following claims. In addition, all ranges of variables are anticipated as combinable with all ranges of any other variable when physically possible.

What is claimed is:

1. A process of removing wax or oil from a textile material, comprising contacting the textile material with a composition comprising:

an alkyl alkoxylate sulfate of formula I:

$$R^1O—(CH_2CH(R^2)—O)_x—(CH_2CH_2O)_y—SO_3M \quad (I);$$

a nonionic alkyl alkoxylate of formula II:

$$R^1O—(CH_2CH(R^2)—O)_x—(CH_2CH_2O)_y—H \quad (II); \text{ and}$$

water wherein $R^1$ is linear or branched $C_4$-$C_{10}$ alkyl;

$R^2$ is $CH_3$ or $CH_3CH_2$;

x is a real number from 1 to 11;

y is a real number from 1 to 20; and

M is an alkali metal or $NH_4$, and wherein $R^1$, $R^2$, x, and y in formula I and formula II may be the same or different.

2. The process of claim 1, wherein the composition further comprises sodium hydroxide.

3. The process of claim 1, wherein the composition further comprises hydrogen peroxide.

4. The process of claim 1, wherein the amount of the alkyl alkoxylate sulfate of formula I is from 20 to 70% by weight, the amount of the nonionic alkyl alkoxylate of formula II is from 0.1 to 30% by weight, the amount of water is from 25 to 75% by weight, the amount of the sodium hydroxide is from 0 to 5% by weight, and the amount of the hydrogen peroxide is 0 to 5% by weight, based on the total weight of the anionic alkoxylate of formula I, the nonionic alkyl alkoxylate of formula II, the water, the sodium hydroxide, and the hydrogen peroxide.

5. The process of claim 1, wherein R1 in formula I and formula II is independently linear or branched $C_6$-$C_{10}$ alkyl.

6. The process of claim 1, wherein $R^1$ in formula I is linear or branched $C_8$ alkyl.

7. The process of claim 1, wherein $R^1$ in formula I and formula II is independently 2-ethylhexyl or 2-propylheptyl.

8. The process of claim 1, wherein y in formula I and formula II is independently from 1 to 11.

9. The process of claim 1, wherein x in formula I and formula II is independently from 4 to 6.

10. The process of claim 1, wherein x in formula I is 5.

11. The process of claim 1, wherein y in formula I is 3.

* * * * *